US008354974B2

(12) United States Patent
Kim

(10) Patent No.: US 8,354,974 B2
(45) Date of Patent: Jan. 15, 2013

(54) ANTENNA COUPLER AND ANTENNA ASSEMBLY HAVING THE SAME

(75) Inventor: Yun Seong Kim, Incheon (KR)

(73) Assignee: Ystech Co., Ltd. (KR)

( * ) Notice: Subject to any disclaimer, the term of this patent is extended or adjusted under 35 U.S.C. 154(b) by 0 days.

(21) Appl. No.: 13/358,816

(22) Filed: Jan. 26, 2012

(65) Prior Publication Data

US 2012/0194407 A1 Aug. 2, 2012

(30) Foreign Application Priority Data

Jan. 27, 2011 (KR) ..... 10-2011-0008331
Nov. 28, 2011 (KR) ..... 10-2011-0125276

(51) Int. Cl.
*H01Q 3/02* (2006.01)
*H01Q 1/24* (2006.01)

(52) U.S. Cl. ..... 343/882; 343/702; 343/900

(58) Field of Classification Search ..... 343/882, 343/880, 702, 900, 906
See application file for complete search history.

(56) References Cited

U.S. PATENT DOCUMENTS 5,673,053 A * 9/1997 Marthinsson ..... 343/728
6,756,943 B2 * 6/2004 Kim et al. ..... 343/702
7,061,433 B2 * 6/2006 Kim et al. ..... 343/702

FOREIGN PATENT DOCUMENTS

KR 10-2004-0098974 11/2004
KR 10-1076567 10/2007
KR 20-2009-000314 1/2009
KR 10-2010-0006269 1/2010

OTHER PUBLICATIONS

Office Action from Korean Intellectual Property Office and English translation (dated Jan. 6, 2012).
Decision of Patent from Korean Intellectual Property Office and English translation (dated May 7, 2012).

* cited by examiner

*Primary Examiner* — Hoang V Nguyen
(74) *Attorney, Agent, or Firm* — Harness, Dickey & Pierce, P.L.C.

(57) ABSTRACT

An antenna coupler, which connects an antenna that is drawn in/out on a portable electronic device and has a hollow pipe type lower end, includes a bushing fixed to an interior of a case of the portable electronic device, a rotary support portion sliding in the bushing to be drawn into the interior of the case when the antenna is drawn in and having an upper end portion that is drawn out to outside of the case, a coupling member having an upper end that is inserted into and coupled to an interior of a lower end of the antenna, and a rotary member having an upper side that is screw-engaged with the coupled member and a lower side rotatably coupling to the upper end portion of the rotary support portion.

7 Claims, 3 Drawing Sheets

ANTENNA COUPLER AND ANTENNA ASSEMBLY HAVING THE SAME

CROSS-REFERENCE TO RELATED APPLICATION

This application is based on and claims priority to Korean Patent Application No. 10-2011-0008331 filed on Jan. 27, 2011 and No. 10-2011-0125276 filed on Nov. 28, 2011 in the Korean Intellectual Property Office, the disclosures of which are incorporated by reference herein in their entireties.

BACKGROUND OF THE INVENTION

1. Field of the Invention

The present invention relates to an antenna coupler and an antenna assembly having the same. More particularly, the present invention relates to an antenna coupler that can be assembled together when an antenna, which is used in an electronic device and is drawn in/out in multistage, is connected and assembled to the electronic device, and an antenna assembly having the same.

2. Description of the Prior Art

Most portable terminals, such as portable phones and PMPs (Portable Multimedia Players), which are commonly used in everyday life, have built-in DMB receiving functions, and users can view TVs or listen to radios during movement using the terminals having the DMB receiving functions. For better reception of broadcasts, the terminals have antennas mounted thereon.

The antenna that is a typical antenna mounted on the terminal as described above has a plurality of rods usually having different diameters and coupled to one another in multistage. As the rods are drawn in/out, one end of the antenna is exposed to outside to receive external radio waves, and the other end of the antenna slides into a bushing that is coupled to a receiving unit of the terminal to receive and transfer the external radio waves.

However, since the above-described antennas of the terminals are projected to outside and are rotated in directions in which the radio waves are easily received, they may be frequency broken or bent due to user's careless handling thereof. The damaged antenna can be repaired using an after-sales service center, and as a typical after-sales service method, the entire terminal is disassembled, the antenna is replaced, and then a new antenna is assembled to the terminal.

However, during the repairing of the above-described terminal, a user may assemble the antenna with a component omitted due to the operator's carelessness, and in such a case, the user should search for an after-sales service center to cause temporal damage to occur.

Further, during the process of disassembling the components, the damage of the components frequently occurs, and this cases the replacement of the components to waste resources.

SUMMARY OF THE INVENTION

Accordingly, the present invention has been made to solve the above-mentioned problems occurring in the related art while advantages achieved by the related art are maintained intact.

An embodiment of the present invention is related to providing of an antenna coupler which enables only a damaged antenna portion to be disassembled and enables a new antenna to be coupled when the antenna of each kind of electronic device is damaged, and which can be easily applied to an existing antenna assembly.

Another embodiment of the present invention is related to easy replacement of an antenna to reduce a working process in the case where the antenna provided in an electronic device is damaged and a minimized loss of components due to mistakes during repairing of the antenna.

In one aspect of the present invention, there is provided an antenna coupler connecting an antenna which is drawn in/out on a portable electronic device and has a hollow pipe type lower end, which includes a bushing fixed to an interior of a case of the portable electronic device; a rotary support portion sliding in the bushing to be drawn into the interior of the case when the antenna is drawn in, and having an upper end portion that is drawn out to outside of the case when the antenna is drawn out; a coupling member having an upper end that is inserted into and coupled to an interior of a lower end of the antenna; and a rotary member having an upper side that is screw-engaged with the coupling member and a lower side rotatably coupling to the upper end portion of the rotary support portion.

The antenna coupler according to the aspect of the present invention may further include a hinge pin coupling the rotary member and the rotary support portion to each other.

A lower end portion of the coupling member may be in the form of a female screw, and the upper end portion of the rotary member may be in the form of a male screw.

By contrast, a lower end portion of the coupling member may be in the form of a male screw, and the upper end portion of the rotary member may be in the form of a female screw.

In the antenna coupler according to the aspect of the present invention, the rotary support portion may have coupling grooves which are formed on one side of an outer periphery of the rotary support portion to be coupled to a tool so as to facilitate separation and coupling between the rotary member and the coupling member.

The coupling grooves may be symmetrically formed on both sides of the rotary support portion.

In another aspect of the present invention, there is provided an antenna assembly, which includes the antenna coupler; and an antenna coupled to an upper end of a coupling member.

Here, the antenna may be a multistage antenna.

According to the antenna coupler and the antenna assembly having the same according to the aspects of the present invention, when the antenna of the electronic device such as the portable terminal is damaged and repair of the antenna is required, only an antenna portion that is exposed to outside of the portable terminal can be replaced without the necessity of replacing the entire antenna assembly through disassembling of the portable terminal, and thus the working time can be reduced to increase the working efficiency. Further, since unnecessary disassembling process of the portable terminal is not required, the lifespan of the terminal can be maximized.

Further, by performing separation and coupling through screw engagement on an upper side of the rotary support portion, the upper end of the rotary support is drawn out with the minimum exposure length, a stable coupling between the rotary support portion and the bushing can be guaranteed, and the antenna coupler can be easily applied to an existing antenna assembly.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
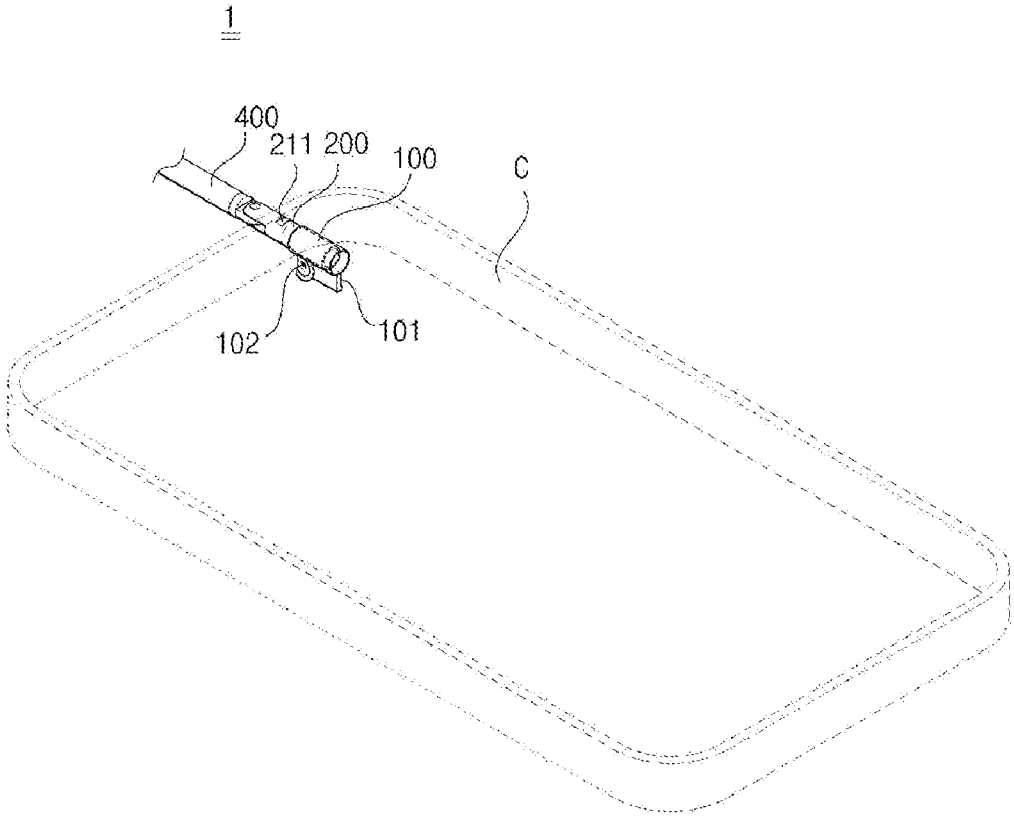
FIG. 1 is a perspective view illustrating an antenna coupler and an antenna assembly having the same according to an embodiment of the present invention.

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto. In the drawings, features of elements may be exaggerated for clarity in explanation. In the entire description of the present invention, the same drawing reference numerals are used for the same elements across various figures. Further, well-known functions and configurations are not described in detail since they would obscure the invention in unnecessary detail.

Hereinafter, an antenna coupler 10 and an antenna assembly 1 according to the present invention will be described in detail with reference to the accompanying drawings.

Figure 2:
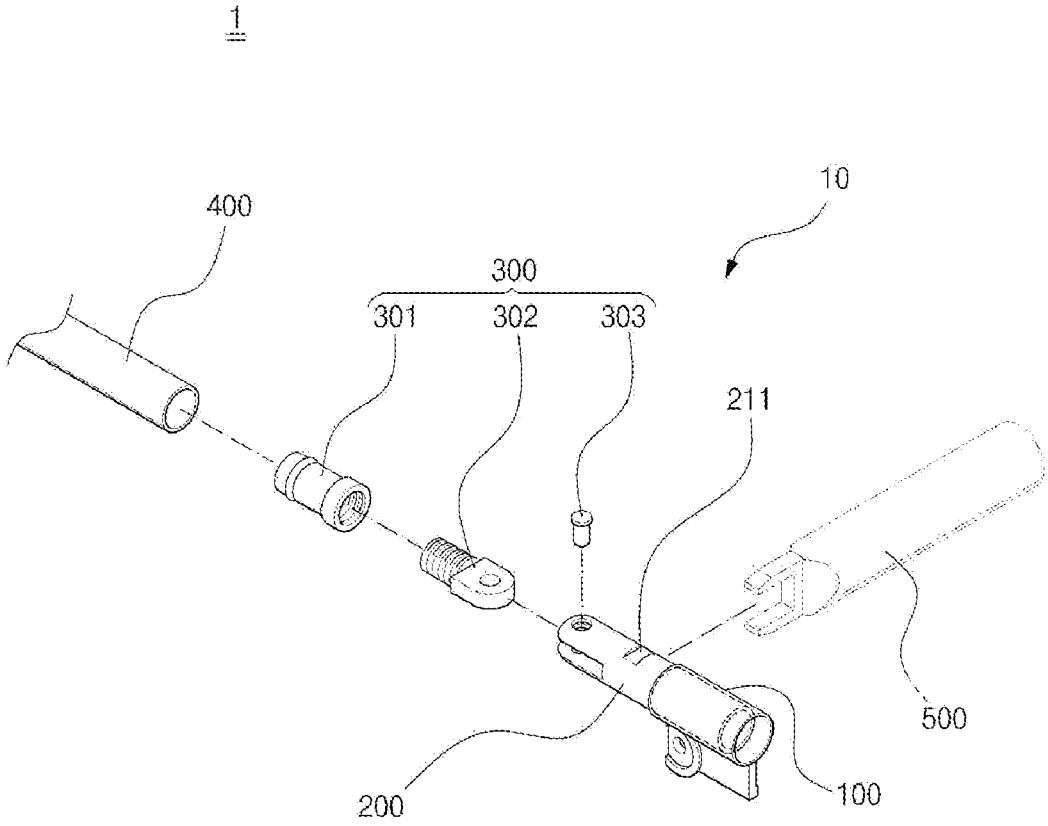
FIG. 2 is an exploded perspective view illustrating the antenna coupler of FIG. 1 and the antenna assembly having the same.
Figure 3:
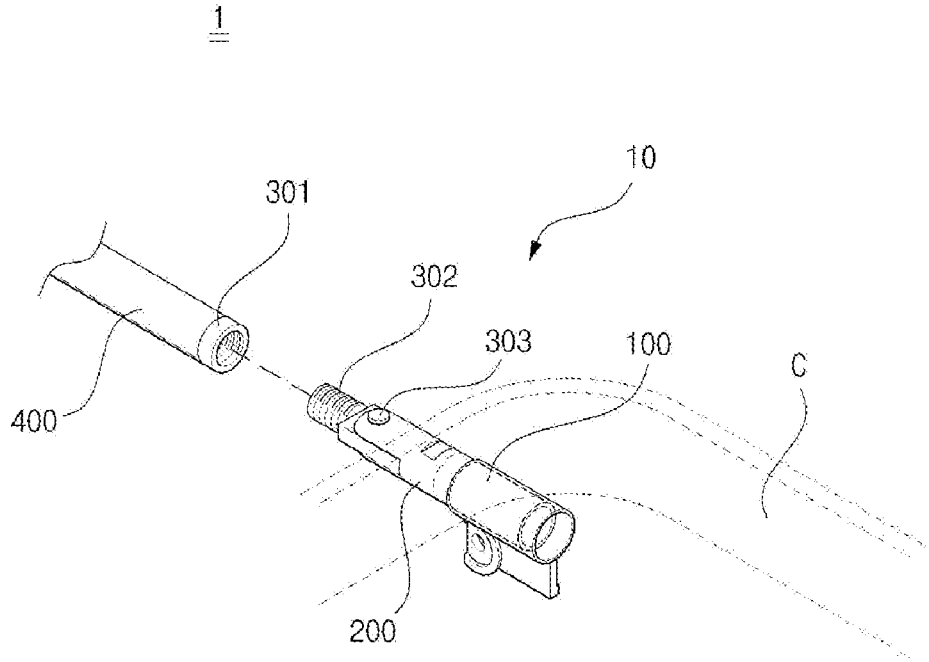
FIG. 3 is a perspective view illustrating a coupling member and a rotary member in a separated state in the antenna coupler illustrated in FIG. 1.

FIG. 1 is a perspective view illustrating an antenna coupler 10 and an antenna assembly 1 having the same according to an embodiment of the present invention, FIG. 2 is an exploded perspective view illustrating the antenna coupler 10 of FIG. 1 and the antenna assembly 1 having the same, and FIG. 3 is a perspective view illustrating a coupling member 301 and a rotary member 302 in a separated state in the antenna coupler 10 illustrated in FIG. 1.

The present invention relates to an antenna coupler 10 that is coupled to an electronic device and an antenna assembly 1 having the same. Here, the portable electronic device may be a notebook computer, an electronic dictionary, a PDA, or a portable terminal such as a portable phone.

A case C of the portable electronic device is a portion that forms a body of the portable electronic device, and on one side of the case C, an image unit composed of an LCD (Liquid Crystal Display) to display a visual image and a keypad for inputting information. The keypad is in the form of a touch screen, and may be integrally formed with the image unit.

The antenna assembly 1 according to the present invention is configured to be completely drawn into the case C of the portable electronic device, and when the antenna 400 is drawn out, the upper end portion of the rotary support portion 200 is exposed to outside.

Since the antenna assembly 1 according to the present invention is drawn out on the basis of the case C, for convenience in explanation, it is assumed that the case C is formed on a lower side, and the antenna 400 is formed on an upper side.

The antenna assembly 1 according to the present invention includes the antenna 400 and the antenna coupler 10. Further, although the antenna 400 is a portion that transmits and receives radio waves and is composed of a single body, it is preferable that it is in the form of a multistage antenna so as to suit a wider range of frequencies.

Here, the multistage antenna means an antenna in which a plurality of pipe-shaped antenna rods having different diameters are coupled to one another in a manner that antenna rods having smaller diameter are consecutively provided inside an antenna rod having a large diameter, and when the antenna is drawn out, the length of the antenna can be extended.

Hereinafter, explanation will be made around the antenna coupler 10.

Referring to FIGS. 1 and 2, according to a first embodiment of the present invention, the antenna coupler 10 includes a portable terminal case C, a bushing 100 connected to a receiving portion that receives an external signal, a rotary support portion 200 sliding in the bushing 100 to be drawn into the interior of the portable terminal, and a connection means 300 connecting the rotary support portion 200 and the antenna 400 to each other. As described above, the antenna 400 has a typical structure in which pipes having different diameters are consecutively inserted to be drawn in/out according to the diameters of the pipes.

Further, although not specifically illustrated, in the rotary support portion 200, a cylinder type insulator made of acetal that is a nonconductive plastic material, a loading coil made of a conductive material such as an enamel material and inserted into one lower portion of the insulator to improve the receiving efficiency through heightening of a resonance frequency, and a finish a portion of which is inserted into a lower end portion of the loading coil.

The bushing 100 is substantially in the form of a cylinder and the rotary support portion 200 is inserted into the bushing 100 to slide therein. A coupling member 101, on which a coupling hole 102 is formed to fixedly guide the drawing-in/out of the antenna in a state where the bushing 100 is coupled to the portable terminal, is formed integrally with or in junction with an outer surface of the bushing 100.

As described above, the bushing 100 is a portion that is fixed to the interior of the case C, and serves as a supporter when the antenna coupler 10 and the antenna 400 according to the present invention are drawn into or drawn out from the case C. FIG. 1 shows a state where the antenna assembly 1 is drawn out from the case C. When the antenna assembly 1 is drawn into the case, the antenna coupler 10 and the antenna 400 are slid downward on the basis of the bushing, and are positioned inside the case C.

On the other hand, the connection means 300 includes a coupling member 301 coupled to the antenna 400, a rotary member 302 having one side coupled to the coupling member 301 and the other side coupled to the rotary support portion 200, and a hinge pin 303 coupling the rotary member 302 and the rotary support portion 200 to each other. A sealing member (not illustrated) is provided on the outer side of coupling member 301, and is force-inserted into one end of the antenna 400.

Although the rotary member 302 and the rotary support portion 200, which have a protrusion and a groove formed thereon, may be hinge-engaged with each other, it is preferable that the engagement between them is performed by a hinge pin 303.

Further, the coupling member 301 and the rotary member 302 are screw-engaged with each other. For this, screw thread is formed on an inner periphery of a lower end of the coupling member 301 to serve as a nut, and screw thread is formed on an outer periphery of an upper end of the rotary member 302 to serve as a bolt. This construction is illustrated in FIGS. 1 to 3.

As described above, it is preferable that the antenna 400 has a hollow pipe type lower end. In the present invention, the antenna 400 and the coupling member 301 are easily coupled to each other, and in order to guarantee the separation and coupling between the coupling member 301 and the rotary member 302, the upper end of the coupling member 301 is inserted into a lower end of the antenna 400, and the lower end of the rotary member 302 is screw-engaged with the rotary member 302.

That is, since the upper end of the coupling member 301 is inserted into the lower end of the antenna 400 to fill in the inner space thereof, the lower end of the antenna 400 is stably supported, and the connection means 300 and the rotary support portion 200 are firmly connected to each other.

It is actually difficult to form screw thread on the antenna 400 itself, and even if it is possible to form screw thread on the antenna 400, this may cause problems in that the durability of the antenna 400 is degraded, it is difficult to form a multistage antenna, and the manufacturing cost is increased. However, according to the present invention, the connection means 300 for connecting the antenna 400 and the rotary support portion 200 to each other, specifically, the coupling member 301 and the rotary member 302, is formed to achieve easy manufacturing, stable coupling, and easy repair.

Further, the rotary support portion 200 is hinge-engaged with a portion on the antenna 400 side so that the antenna 400 is rotatable in a user's desired direction on the basis of the portable electronic device, and for this operation, the upper end of the rotary support portion 200 is exposed to the outside of the case C. That is, it is sufficient if the upper end of the rotary support portion 200 is upwardly exposed only within the range in which the coupling member 301 and the rotary member 302 can be rotated.

Further, the rotary support portion 200 is coupled to the bushing 100 as it slides in the bushing 100, and the lower portion of the rotary support portion 200 is not exposed to the outside of the case C. Particularly, in the case where the rotary support portion 200 is excessively drawn out from the bushing 100, a large load may be applied to the connection portion between the rotary support portion 200 and the bushing 100 with the risk of damage.

In consideration of this point, according to the present invention, the separation and coupling through the screw engagement is performed on the upper side of the rotary support portion 200, that is, between the coupling member 301 and the rotary member 302 that constitute the connection means 300, and the upper end of the rotary support portion 200, the upper end of the rotary support is drawn out with the minimum exposure length, a stable coupling between the rotary support portion and the bushing can be guaranteed, and the antenna coupler can be easily applied to an existing antenna assembly.

As described above, according to the present invention, the coupling member 301 and the rotary member 302 are coupled to each other or separated from each other through the screw engagement, and in the antenna assembly 1, the antenna 400 can be easily separated from the portable electronic device.

That is, if repair or replacement of the antenna 400 is required due to the damage of the antenna 400, only the damaged portion of the antenna 400 can be easily replaced through releasing of the screw engagement between the coupling member 301 and the rotary member 302 rather than repairing the antenna assembly 1 through disassembling of the entire case C.

More specifically, in the antenna coupler 10 according to the present invention, the upper end portion of the rotary support portion 200 is drawn out from the case C when the antenna 400 is drawn out, and by releasing the screw engagement between the coupling member 301 and the rotary member 302 that is exposed to the outside as shown in FIG. 3, the portion of the antenna 400 can easily be separated. Accordingly, the occurrence of problems due to the disassembling of the case C can be prevented, and lower-side components of the rotary member 302 can still be used to same the repairing expenses.

On the other hand, the rotary support portion 200 may have coupling grooves 211 which are symmetrically formed on one side of an outer periphery of the rotary support portion 200 to be coupled to a tool 500 so as to facilitate the separation between the rotary member 302 and the coupling member 301. The coupling member 301 and the rotary member 302 are coupled to each other with a predetermined pressure so that they are not easily released by hand or external motion, and thus it is difficult to disassemble them from each other without using a separate tool 500. In other words, the tool 500 is inserted into and fixed to the coupling grooves 211, and in the case of disassembling them from each other, the antenna 400 or the coupling member 301 is rotated using the tool for repair such as a wrench.

The coupling grooves 211 may be symmetrically formed on both side surfaces of the rotary support portion 200, and in this case, the tool can stably be coupled to the coupling grooves 211.

Figure 4:
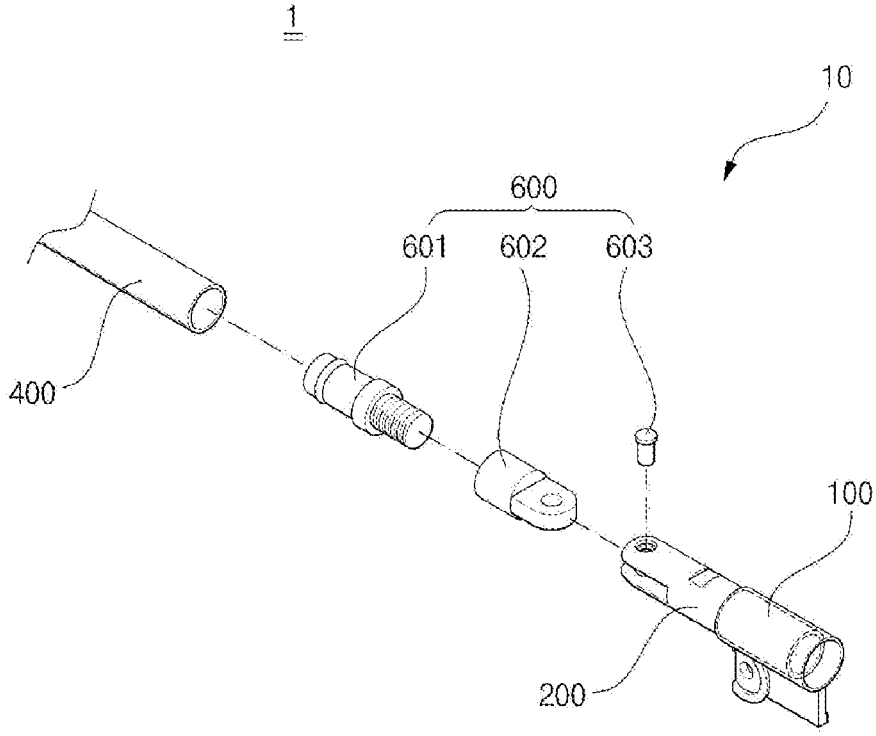
FIG. 4 is an exploded perspective view illustrating an antenna coupler and an antenna assembly having the same according to another embodiment of the present invention.

FIG. 4 is an exploded perspective view illustrating an antenna coupler 10 and an antenna assembly 1 having the same according to another embodiment of the present invention.

according to the second embodiment of the present invention, the antenna coupler 10 includes a portable terminal case C, a bushing 100 connected to a receiving portion that receives an external signal, a rotary support portion 200 sliding in the bushing 100 to be drawn into the interior of the portable terminal, and a connection means 300 connecting the rotary support portion 200 and the antenna 400 to each other. Except for a coupling member 601 and a rotary member 602 that constitute the connection means 600, the configuration of the antenna coupler 10 is the same as the configuration according to the first embodiment of the present invention as described above.

That is, screw thread is formed on an outer periphery of a lower end of the coupling member 601 to serve as a bolt, and screw thread is formed on an inner periphery of an upper end of the rotary member 602 to serve as a nut, so that the coupling member 601 and the rotary member 602 are screw-engaged with each other.

The rotary member 602 and the rotary support portion 200 are hinge-engaged with each other through a hinge pin 603.

Of course, the coupling member 601 and the rotary member 602 are coupled to each other or separated from each other through the screw engagement, and in the antenna assembly 1 according to the present invention, the antenna 400 can be easily separated from the portable electronic device.

As described above, the antenna coupler 10 according to the embodiments of the present invention is exemplary, and the aspects and features of the present invention will be apparent to those having an ordinary skill in the art. Accordingly, it can be understood that the present invention is not limited to the embodiments as disclosed herein. Accordingly, the present invention is only defined within the scope of the appended claims. Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An antenna coupler connecting an antenna which is drawn in/out on a portable electronic device and has a hollow pipe type lower end, comprising:

a bushing fixed to an interior of a case of the portable electronic device;

a rotary support portion sliding in the bushing to be drawn into the interior of the case when the antenna is drawn in, and having an upper end portion that is drawn out to outside of the case when the antenna is drawn out;

a coupling member having an upper end that is inserted into and coupled to an interior of a lower end of the antenna; and a rotary member having an upper side that is screw-engaged with the coupling member and a lower side rotatably coupling to the upper end portion of the rotary support portion, wherein the rotary support portion comprises a coupling grooves which are formed on one side of an outer periphery of the rotary support portion to be coupled to a tool so as to facilitate separation and coupling between the rotary member and the coupling member.

2. The antenna coupler according to claim 1, further comprising a hinge pin coupling the rotary member and the rotary support portion to each other.

3. The antenna coupler according to claim 1, wherein a lower end portion of the coupling member is in the form of a female screw, and the upper end portion of the rotary member is in the form of a male screw.

4. The antenna coupler according to claim 1, wherein a lower end portion of the coupling member is in the form of a male screw, and the upper end portion of the rotary member is in the form of a female screw.

5. The antenna coupler according to claim 1, wherein the coupling grooves are symmetrically formed on both sides of the rotary support portion.

6. An antenna assembly comprising:

an antenna coupler according to any one of claims 1 to 5; and an antenna coupled to an upper end of a coupling member.

7. The antenna assembly according to claim 6, wherein the antenna is a multistage antenna.

* * * * *